United States Patent [19]

Block

[11] 4,236,385

[45] * Dec. 2, 1980

[54] EARRING

[75] Inventor: Alvin Block, Bedford, N.Y.

[73] Assignee: Intimate Jewels Inc., Katonah, N.Y.

[ * ] Notice: The portion of the term of this patent subsequent to Oct. 9, 1996, has been disclaimed.

[21] Appl. No.: 32,652

[22] Filed: Apr. 23, 1979

Related U.S. Application Data

[63] Continuation of Ser. No. 875,246, Feb. 6, 1978, abandoned.

[51] Int. Cl.[3] ..... A44C 7/00

[52] U.S. Cl. ..... 63/12; 85/36

[58] Field of Search ..... 63/12, 13; 85/36

[56] References Cited

U.S. PATENT DOCUMENTS

| | | | |
|---|---|---|---|
| 439,457 | 10/1890 | Whittemore et al. | 63/12 X |
| 896,695 | 8/1908 | Harvey | 85/36 X |
| 1,867,041 | 7/1932 | Walters | 85/36 X |
| 2,144,926 | 1/1939 | Lawton | 85/36 X |
| 2,208,779 | 7/1940 | Tinnerman | 85/36 X |
| 2,373,002 | 4/1945 | Armstrong | 63/12 X |
| 3,040,406 | 6/1962 | Artzt | 63/12 X |

FOREIGN PATENT DOCUMENTS

| | | | |
|---|---|---|---|
| 295468 | 3/1954 | Switzerland | 63/12 |
| 478782 | 1/1938 | United Kingdom | 85/36 |

*Primary Examiner*—F. Barry Shay

*Attorney, Agent, or Firm*—Kirschstein, Kirschstein, Ottinger & Cobrin

[57] ABSTRACT

An improvement in post-type earrings, which are earrings connected to a human ear by a rigid slender short rod or post. One end of the post is attached to an ornament. The post is rectilinear and cylindrical and extends from attachment to the ornament. In service, the other end of the post is pushed through an opening in a person's ear, and a suitable element is attached to the other end of the post to secure the earring on the ear. In the present invention, at least a portion of the outer surface of the post has a helical threading. The element used to secure the post on the ear is a clutch having a central opening about which are radially arrayed a plurality of spaced apart springy fingers. The fingers extend to terminal attachment to a base portion of the clutch. The clutch is engageable by the post by extending the post axially through the opening in the clutch, until the tips of the springy fingers pass over the convolutions of the threading and are held in the threading. The fingers cannot be moved reversely in an axial direction because in this direction they catch on the flanks of the threads. To disengage the clutch from the post, the clutch must be rotated about the post, so that in effect the clutch is pushed on axially and screwed off by rotary motion.

3 Claims, 7 Drawing Figures

FIG. 4
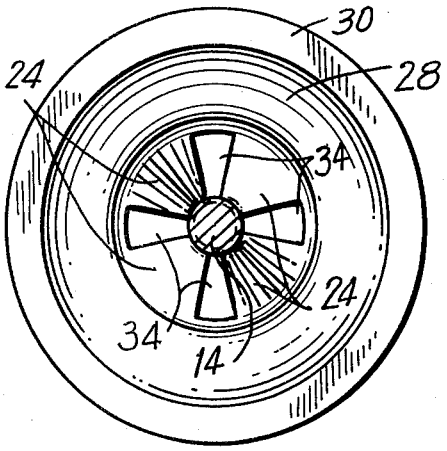
FIG. 5
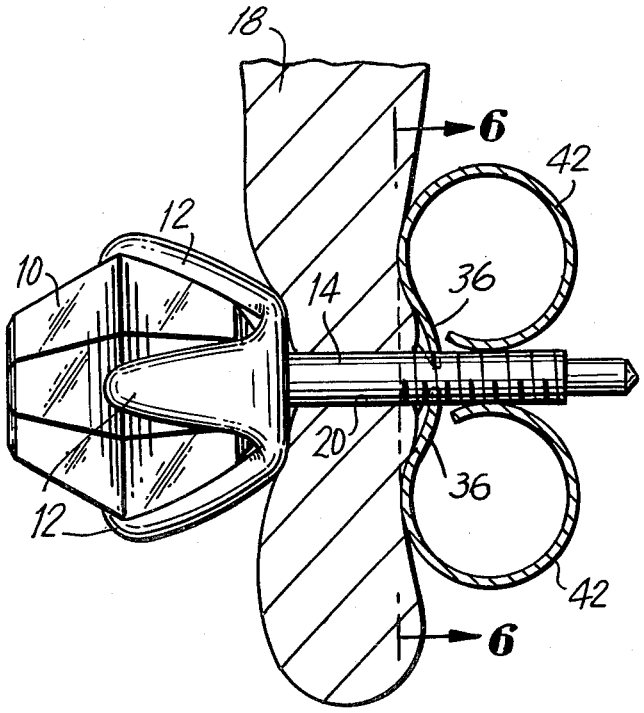
FIG. 6
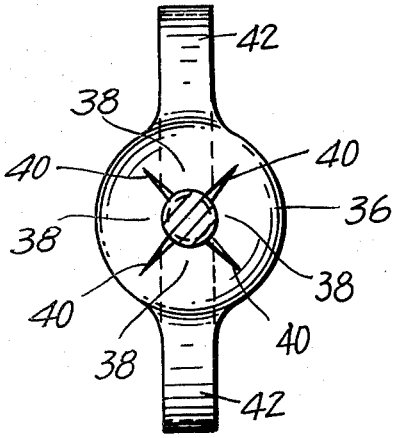
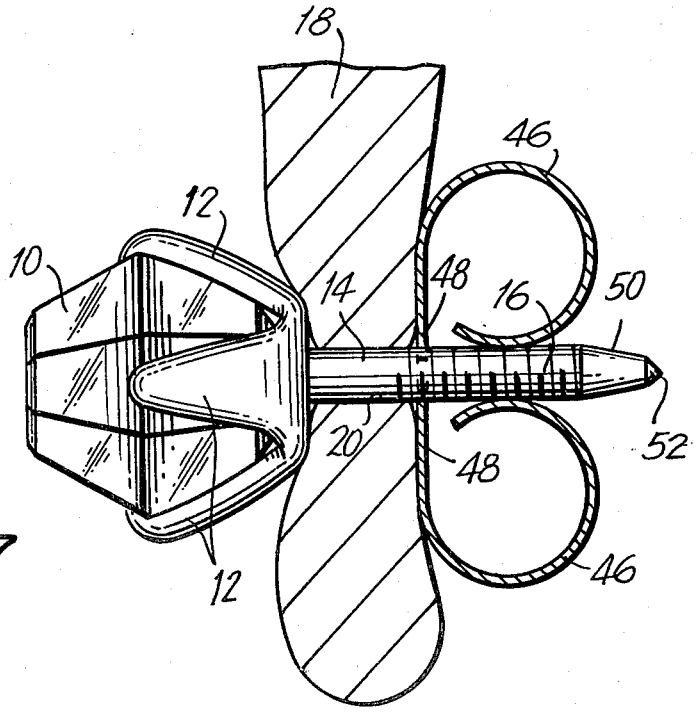
FIG. 7

EARRING

This is a continuation, of application Ser. No. 875,246 filed Feb. 6, 1978.

BACKGROUND OF THE INVENTION

1. Field of the Invention

A post-type earring for pierced ears.

2. Description of the Prior Art

There are two kinds of earrings that are used for pierced ears. One is the so-called "wire" earring. The other is the so-called "post" earring. In a wire earring, the dangling ornament is provided with a U-shaped thin wire at one end of the ornament. One branch of the U is connected to the ornament permanently, the other end of the U is threaded through a person's ear and then is engaged with a catch of the ornament.

A post earring is connected to an ear by a rigid slender short rod or post. One end of the rod is attached to the ornament; the other end of the rod is pushed through the opening in a person's ear, and then a friction nut is slid onto this other end. This nut has a central opening defined by the tips of a plurality of resilient fingers. The fingers frictionally engage on the rod or post. The friction nut slides onto the post easily and slides off with difficulty. The problem with this type of prior art earring is that the friction nuts can become displaced accidentally, for instance, while the person is engaged in physical exertion or sleeping.

Among the prior art on this type of earring may be mentioned U.S. Pat. Nos. 3,882,702 and 2,373,002.

SUMMARY OF THE INVENTION

1. Purposes of the Invention

It is an object of the present invention to provide an improved earring.

Another object is to provide an improved post-type earring.

A further object is to provide post-type earring in which the friction nut or clutch is pushed on and screwed off.

An additional object is to provide a post-type earring in which the clutch is self-locating onto the post.

Still another object is to provide a post-type earring in which the clutch is mounted on the post by a ratchet-like movement but must be screwed off for removal from the post.

Still a further object is to provide a post-type earring in which the clutch is shaped to provide a stronger ratchet and better ratchet effect.

Still an additional object is to provide a post-type earring in which the hole in the rear clutch is self-locating so that a woman emplacing the earring is assisted in getting the post into the hole.

An object is to provide a post-type earring in which the post is cammed into the hole in the clutch.

An object is to provide an earring which cannot be dislodged by strenuous physical activity or the like, but only by screwing the clutch or friction nut off of the post.

An object is to provide an earring in which the clutch is readily emplaced on the post and yet is not easily accidentally dislodged when once emplaced, and is only removable by the positive and conscious effort of screwing the clutch off of the post.

These and other objects and advantages of the present invention will become evident from the description which follows.

2. Brief Description of the Invention

The present earring post differs from a conventional post in that instead of a smooth post, a post is provided with a threaded helix, and also in that instead of the usual friction clutch, a clutch is provided with springy fingers. When this clutch is pushed on to the post, it can slide smoothly in an engaging direction, there being a ratchet-like passage of the tips of the fingers over the crests of the convolutions of the threads. However, the fingers cannot be moved reversely in an axial direction, because in an axial direction they catch on the flanks of the threads. To remove the springy fingers and thereby release the post, the fingers have to be rotated about the post. Thus the present concept entails an axial push type engagement of the clutch, with rotary disengagement. In other words, where the conventional post was smooth, the new post is formed with a helical rib, i.e., a thread. The new post is used in the same way as the old one, that is to say, it is pushed through a person's ear and then a friction nut is pushed on to it. However the nut cannot be pulled off, because the thread is too great an impediment to axial removal of the nut. Instead, it must be screwed off.

To summarize, the present earring for pierced ears includes an ornament, a rectilinear cylindrical post, and a clutch. The post extends from attachment to the ornament. At least a portion of the outer surface of the post has a helical threading. The clutch has a central opening defined by the tips of a plurality of radially-extending fingers. In other words, a plurality of spaced apart springy fingers are radially arrayed about a central opening in the clutch. The fingers extend to terminal attachment to a base portion of the clutch. Thus the clutch is engageable by the post by extending the post axially through the opening in the clutch, so that the tips of the fingers pass over the convolutions of the threading. The clutch may be disengaged from the post only by rotating the clutch.

In most instances the fingers will extend outwards from the plane of the base, so that the fingers define a concave recess for entry of the post into the central opening in the clutch. In this case, typically the fingers are curved, so that the curved fingers define a cup-shaped extension from the base, which extension defines the concave recess.

The base may be disc-shaped, in which case, in a preferred embodiment, a circular lip depends from the perimeter of the base. In an alternative embodiment when the base is discshaped, two opposed arms extend outwards from the base, which arms are preferably substantially circular. The base may alternatively be hemispherical, with the two opposed circular arms configuration also being provided in this case. The outer end portion of the post may be free of threading and/or may be tapered, with the outer end terminus of the post being of minimum cross-sectional area.

The present earring provides several salient advantages. The present improved post-type earring features a friction nut or clutch which is pushed on and screwed off, thus an improved earring fastening means is provided which is readily mounted on the post, yet is secure and not removable except by screwing off. Thus the clutch is mounted on the post by a ratchet-like movement, but must be screwed off for removal from the post. The clutch is self-locating onto the post, because of the configuration of the fingers which provide a cup-like concave recess for ingress of the post. The clutch is shaped to provide a stronger ratchet and a better ratchet effect. The hole in the rear or back clutch is self-locating so that a woman emplacing the earring is assisted in getting the post into the hole, i.e., the post is cammed into the hole in the clutch. The present earring when once emplaced cannot be dislodged by strenuous physical activity or the like, but only when the clutch or friction nut is screwed off. Thus an advantage is that the clutch is readily emplaced on the post simply by pushing it onto the post, and yet the clutch cannot be accidentally dislodged when once emplaced, and is only removable by the positive and conscious effort of screwing the clutch off of the post.

The invention accordingly consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which are shown several of the various possible embodiments of the invention:

FIG. 4 is a sectional elevation view taken substantially along the line 4—4 of FIG. 3;

FIG. 5 is a sectional elevation view of an alternative embodiment of the present invention;

FIG. 6 is a sectional elevation view taken substantially along the line 6—6 of FIG. 5; and FIG. 7 is a sectional elevation view of still another alternative embodiment of the invention.

DETAILED DESCRIPTION OF THE PREFERRED EMBODIMENTS

Figure 1:
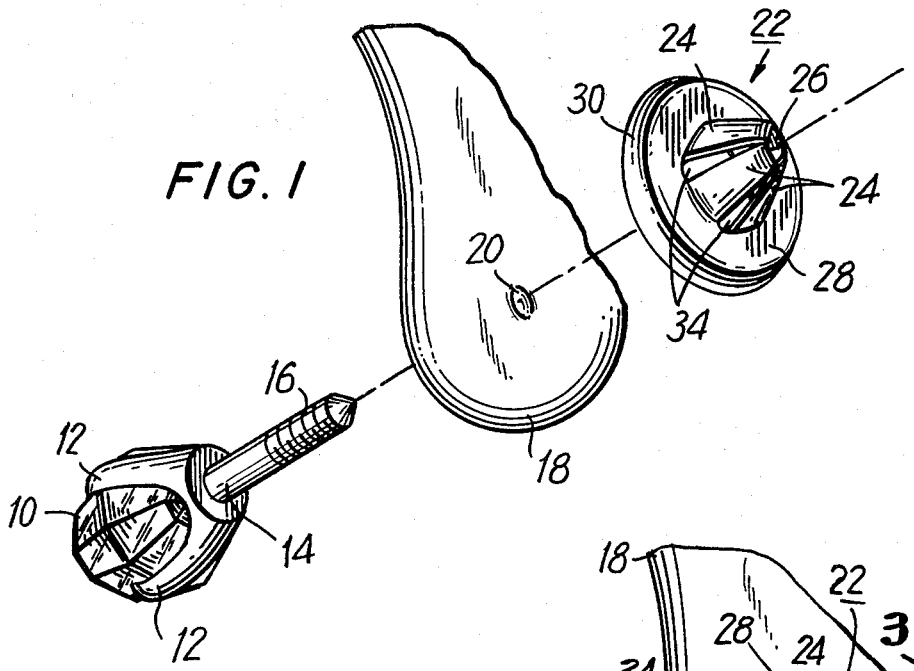
FIG. 1 is an exploded perspective view of one embodiment of the present earring, shown in conjunction with a portion of a human ear on which the earring is to be mounted.
Figure 2:
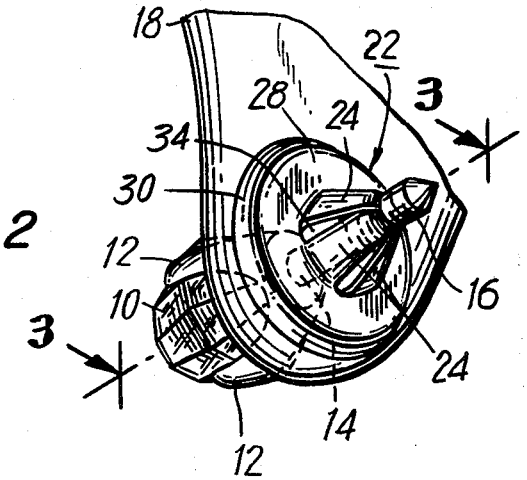
FIG. 2 shows the earring of FIG. 1 in place on the ear, still in perspective view.
Figure 3:
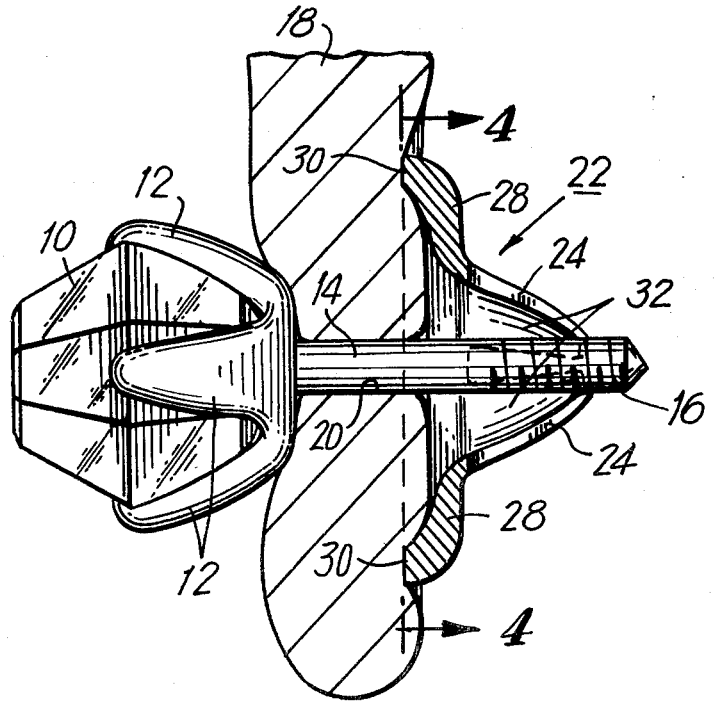
FIG. 3 is a sectional elevation view taken substantially along the line 3—3 of FIG. 2.

Referring now to FIGS. 1 and 2, an ornament 10 is mounted via fingers 12 to one end of a rod or post 14 which is provided with annular threading 16 along the other end of its length. An ear lobe portion 18 having an opening or hole 20 is shown; the earring is mounted to the ear portion 18 in FIG. 2. This has been accomplished by extending or threading post 14 through opening 20, and then sliding clutch or friction nut member 22 onto threaded end 16 of post 14. The clutch 22 is characterized by the provision of the plurality of springy fingers 24, the tips of which define a central opening 26 (FIG. 1) in which the theaded section 16 of post 14 has been lodged. The fingers 24 extend radially from a ring-shaped or disc-shaped base 28. As best shown in FIG. 3, the base 28 of the clutch 22 has an outer annular lip 30 which presses into the ear lobe 18 when the clutch 22 is emplaced. FIG. 3 shows the concave recess 32 formed by the fingers 24, while FIG. 4 shows the radial orientation of the fingers 24 which are separated by slits 34.

FIGS. 5 and 6 show a concave central disc-shaped clutch 36 having fingers 38 (FIG. 6) separated by slits 40. In addition, FIGS. 5 and 6 show two opposed circular arms 42 extending outwards from the base 36. Finally, as shown in FIG. 5, the outer end portion 44 of the post 14 is free of threading.

Thus, in FIGS. 5 and 6, slits 40 are provided in the concave shape 36 for a ratchet effect. The concave shape of element 36 makes the post self-locating and yields a stronger ratchet.

FIG. 7 is similar to the FIG. 5 embodiment, in that two opposed circular arms 46 are provided, however the central clutch section 48 is flat rather than concave, and the end portion 50 of the post 14 is tapered to an outer end terminus 52 of minimum cross-sectional area.

The spring-like nature of the fingers 24 or 38 insures a yielding when the clutch is pushed onto the post, however the configuration of the fingers namely the inclination of the fingers out of the plane of the base of the clutch so as to form a concave recess, insures that the clutch cannot be pulled off of the post but must be screwed off in all cases.

It thus will be seen that there is provided an earring which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. An earring for pierced ears which comprises an ornament, a rectilinear cylindrical post, said post extending from attachment to said ornament, at least a portion of the outer surface of said post having a helical threading, and a clutch, said clutch having a central opening about which are radially arrayed a plurality of spaced apart springy fingers, said fingers extending to terminal attachment to an annular disc-shaped base, so that said clutch is engageable by said post by extending said post axially initially through the middle of said annular base and then through the opening in said clutch whereby the tips of said springy fingers engage and pass over the convolutions of the threading, and so that said clutch may be disengaged from said post only by rotating said clutch to unscrew the tips of said fingers through the convolutions of the threading, said fingers extending outwards from the plane of the base and being curved, so that said fingers are springy, said curved springy fingers defining a cup-shaped extension from the base, said extension defining a concave recess, at least a portion of the threaded portion of said post extending through said concave recess, and a circular lip, said lip depending from the perimeter of said base and being of thicker cross-sectional dimension than said base, the free end of said lip terminating with a substantially flat planar surface for contact with and for pressing into the earlobe of said pierced ear, said surface being parallel to the plane of said base.

2. The earring of claim 1 in which the outer end portion of the post is free of threading.

3. The earring of claim 1 in which the outer end portion of the post is tapered, with the outer end terminus of the post being of minimum cross-sectional area.

* * * * *